US008220763B2

(12) United States Patent
Lewis

(10) Patent No.: US 8,220,763 B2
(45) Date of Patent: Jul. 17, 2012

(54) ADJUSTABLE BEVERAGE HOLDER

(76) Inventor: Jack W. Lewis, Sulphur Springs, TX (US)

( * ) Notice: Subject to any disclaimer, the term of this patent is extended or adjusted under 35 U.S.C. 154(b) by 371 days.

(21) Appl. No.: 12/108,933

(22) Filed: Apr. 24, 2008

(65) Prior Publication Data

US 2009/0266961 A1 Oct. 29, 2009

(51) Int. Cl.
*A47K 1/08* (2006.01)
*B60R 9/55* (2006.01)

(52) U.S. Cl. ..... 248/311.2; 248/316.7; 224/328

(58) Field of Classification Search ..... 248/311.2, 248/174, 175, 316.7, 309.1, 37.6, 104, 107, 248/112, 302, 318; 224/671, 678, 679, 680, 224/681, 677, 578, 324, 325, 326, 327, 328; 206/201, 202, 142, 156, 513
See application file for complete search history.

(56) References Cited

U.S. PATENT DOCUMENTS 5,088,666 A * 2/1992 Lang ..... 248/87
5,092,395 A * 3/1992 Amidzich ..... 248/311.2
5,195,668 A * 3/1993 Kunes et al. ..... 224/312
6,182,878 B1 * 2/2001 Racca ..... 224/605
6,195,926 B1 * 3/2001 Jarl et al. ..... 40/645
6,412,674 B1 * 7/2002 Lipke ..... 224/240
D461,682 S * 8/2002 Fandrey ..... D7/409
6,478,205 B1 * 11/2002 Fujihashi ..... 224/675
6,622,978 B1 * 9/2003 Ghiz ..... 248/110
6,729,518 B2 * 5/2004 Badillo et al. ..... 224/578
6,823,625 B2 * 11/2004 Weder ..... 47/72
6,938,942 B1 * 9/2005 Ytterberg ..... 296/97.9
7,037,074 B2 * 5/2006 Hoshino ..... 416/62
2009/0266961 A1 * 10/2009 Lewis ..... 248/311.2

* cited by examiner

*Primary Examiner* — Tan Le
(74) *Attorney, Agent, or Firm* — Hemingway & Hansen, LLP; Eugenia S. Hansen

(57) ABSTRACT

A holder comprising a frame support and a covering encasing the frame support. The frame comprises a ductile material which can be conformed to a portion of the shape of an object to be secured in the holder. The holder has one or more flaps. In a preferred embodiment, the holder comprises 2-6, preferably four flaps having a configuration defined by the frame support. One of the flaps serves as an attachment means to secure the holder to a desired structural support. The holder may serve as a holder of a variety of objects such as, for example, cans, bottles, cups, boxes, packages, and tools. The holder may be provided with a feature which allows one or more holders to be used in conjunction with each other.

18 Claims, 5 Drawing Sheets

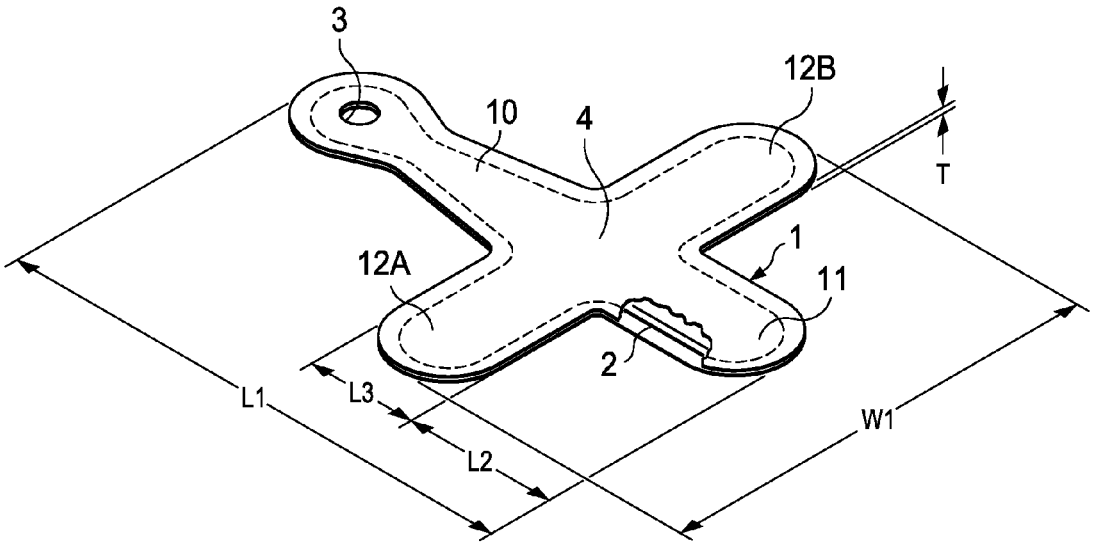
FIG. 1
FIG. 2
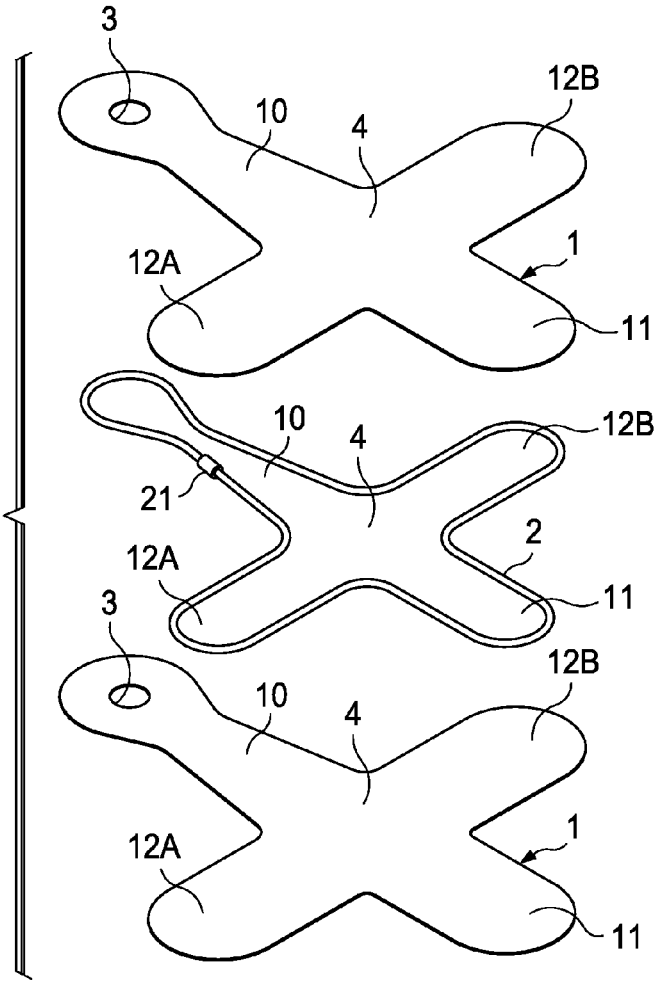

FIG. 6A
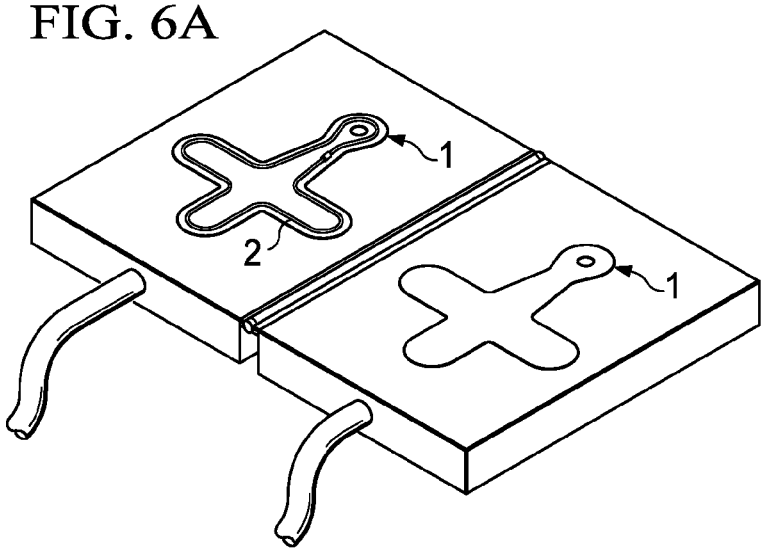
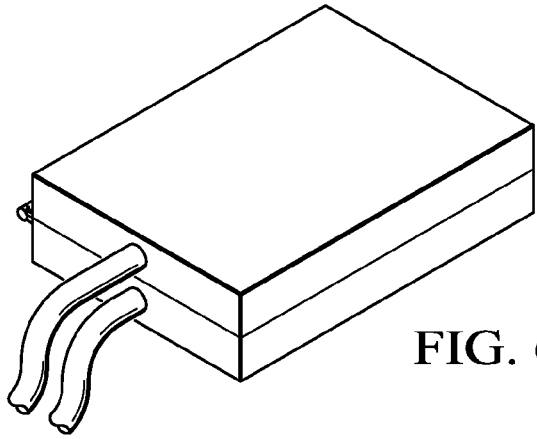
FIG. 6B
FIG. 6C
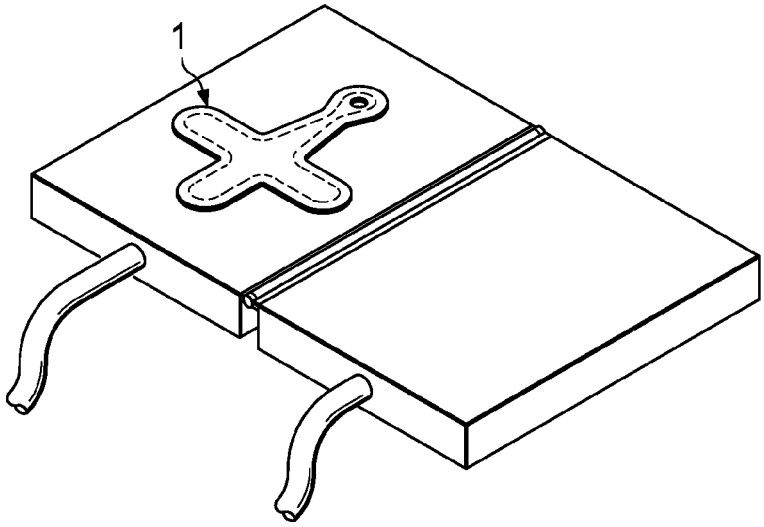

ADJUSTABLE BEVERAGE HOLDER

CROSS REFERENCE TO RELATED APPLICATIONS

Not Applicable

STATEMENT REGARDING FEDERALLY SPONSORED RESEARCH OR DEVELOPMENT

Not applicable.

TECHNICAL FIELD OF INVENTION

This invention relates to the field of beverage and cup holders.

BACKGROUND OF THE INVENTION

People have demonstrated the desire to consume beverages and snacks, contained in cans, bottles, cups, packages and the like in cars or other vehicles or mobile transportation means, at or near sporting events, and in other locations remote from the dining room. Consequently, various devices have been disclosed for holding beverages and snacks in a secure manner so as to avoid spillage in such remote locales. However, there is a continuing need for improved devices adapted for this purpose.

BRIEF DESCRIPTION OF THE DRAWINGS

FIG. 1 is a front view of the invention.

FIG. 2 is an exploded perspective of the invention.

FIG. 6 is a perspective view of a production method of the invention.

DETAILED DESCRIPTION

Figure 3:
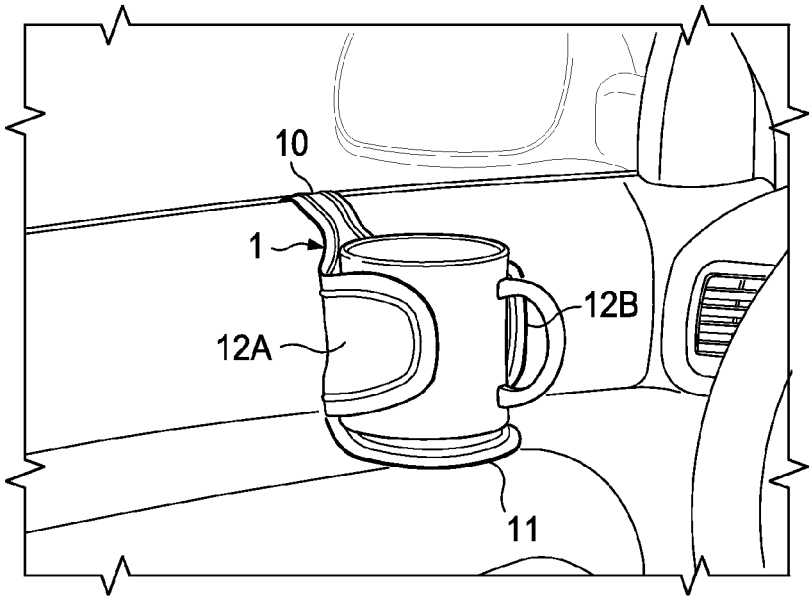
FIG. 3 is an environmental view of the invention.

The invention herein disclosed comprises a device useful for holding/securing beverage containers or similar items. The device is adapted for securing cans, bottles, boxes, packages and items of similar size and configuration.

The device comprises a frame support and a covering. The frame support preferably is made of a frame support wire which may be bent or molded into a predetermined shape. Preferably a steel wire is used, but other wire materials may be used, for example copper, aluminum, and other metals which may be formed into the predetermined shape and which have the desired degree of ductility and strength. Appropriate exemplary wire is 0.08" (14 gauge) steel wire, 3/16" (diameter) copper wire and ¼" (diameter) aluminum wire. The diameter of the wire selected can be larger as long as the diameter of the wire does not prevent the forming of the embodiment to a reasonable desired functional shape. The wire chosen must be able to be formed to the desired shape and hold the shape. It should have sufficient strength in the formed configuration to hold between about 3 and 5 lbs.

The frame support preferably defines at least four flaps, but could have anywhere from two to six flaps, extending from a central core area. The central core area provides an area of stability for the structure.

The loose ends of the frame support wire are secured together by crimping, welding, or by any suitable means Known to the art so as to create said frame support which serves to provide strength and support to the device. In addition, the frame support is flexible and can be conformed to a configuration which will secure a desired object.

The frame support is preferably provided with a covering. The covering serves to encase the frame support so as to encase any sharp or abrasive edges or surfaces thereof. In addition, the covering provides additional surface area that may contact the desired object while in use. The covering may be created from a variety of materials, for example cloth, paper, foil, fabric, vinyl, and Mylar polyester. In general the material used for the covering should have pliability so as to not to prevent the frame support from bending to a desired shape or to hold its desired shape. The covering material preferably is comprised of a printable material to allow the invention to serve as an item suitable for promotion or advertising. Most preferred is calendared vinyl which is between 3-8 mil (1/16 in=62.5 mils).

A first and second side of the covering may be cut from sheet material. The frame support may be secured to said first side, then said second side may be secured to said first side thereby encasing said frame support therebetween.

In a preferred embodiment, the covering comprises a strong and sturdy, yet pliable, material having a self-backed adhesive. The self-backed adhesive material comprises a removable backing which exposes adhesive when removed from the material. This permits convenient assembly of the device since the frame support can be encased between the adhesive by removing the backing from a first side of said covering to expose the adhesive, adhesively securing the frame support thereto, then removing the backing from the second side of said covering and sticking it to the opposite side of the frame support and to the first side of the covering, thereby forming an encased frame support. The edges of the covering can be finished if desired by heat sealing, sewing, stitching, or by application of a separate edging piece or like or other pliable material. The edging may be secured by stitching, gluing or other attachment methods. The edging may be in the configuration of double faced seam binding which can overlap the edge and wherein one face is secured to one side of the edges and the other to the other side of the edge, or a stitching applied through all layers.

The invention provides versatility through its ability to adjust to many shapes and sizes. Some examples of objects that could be contained by the invention are cans, beverage cups, beverage bottles, juice boxes, and the like. Other examples of objects which can be secured by the invention are containers of food, such as french fries, bags of chips, sandwiches and the like. The invention itself, frame support and covering, may also be produced in a larger version to accommodate larger items. Thus, the invention is not limited to one size.

The invention secures the desired object by conforming to the object or a portion thereof in such a way as to provide the securing functionality. The frame support of the device is ductile and thus may be conformed as desired. Once conformed to the desired shape, the device of the invention retains the shape until later altered by user. This is advantageous since the user may habitually use the device to hold objects of particular configurations and only slight adjustments may be needed in day to day use.

The flexibility of the invention allows the flap to conform to an object as needed yet be secured to a wide variety of stabilizing structures. For example, the stabilizing structure may be a portion of a car interior. The flap could be secured to the car door by inserting the top flap between the window and door in the space provided by the usual construction of the car. Other portions of a car interior, such as handles, seat pockets, glove compartments or other structures may also be suitable for a stabilizing structure to which the invention can be secured. The invention can be secured to bicycle or motorcycle portions, such as the handle bars or other structures. Other stabilizing structures can include walls comprising a structure to which the invention can be secured. Other examples are chain link fences, such as commonly used to surround athletic fields or in baseball dugouts, where the invention may be employed by sports teams or fans. The bleachers, stadium seats, and other stabilizing structures may be suitable for receiving a flap of the invention by hooking onto or wrapping about a portion of the same. Further, the invention can be secured to a body part or a portion of apparel such as a belt. The invention allows users to place a beverage or object holder in an almost limitless array of environments and to provide convenient access to such objects as beverages and snacks. The invention can be employed by persons who wish to hold tools or other objects, such as mobile phones, personal data assistants, audio playing devices, and the like, in a convenient manner. It can be employed for organization so as to accommodate a wide variety of shapes and sizes and secure them to a stabilizing structure.

FIG. 1 shows a preferred embodiment of the invention from a top view just after manufacture thereof. This embodiment comprises four flaps, a top flap (10), a bottom flap (11), and two side flaps (12A and 12B). While FIG. 1 shows the flaps with different lengths, the holder may be made with flaps of differing relative dimensions. For example, the flaps can be symmetrical or the invention itself can be made larger to accommodate larger objects.

Again referring to FIG. 1, the flaps extend from a central core area (4) which provides a core area of support. A cutaway portion shows the frame support (2) which is encased in covering (1) and would otherwise not be visible. The dashed lines show the position of frame support (2) within the covering. The covering defines aperture (3) which is an optional feature that may be included in the device, discussed in more detail below.

FIG. 2 is an exploded perspective view showing the preferred configuration of frame support (2) of the invention and two layers of covering. In this illustration one can see connection area (21) on frame support (2) where the ends of the wire of which the frame support is comprised are joined. One can also see the layers of covering material which are joined to encase the frame support.

Preferred dimensions of the embodiment illustrated in FIG. 1 for from the apex of flap (12A) to the apex of flap (12B) denoted as (W1) are from about 5 inches to about 15 inches, preferably about 7 inches to about 13 inches and most preferably about 10 inches. Dimension (L1) ranges from about 6 inches to about 18 inches, preferably from about 9 inches to about 13 inches, and most preferably about 12 inches. Dimension (L3) representing the distance from the top edge of the side flap (12A) or (12B) to the bottom edge of the side flap ranges from about 0.25 inches to about 5.0 inches, preferably from about 1.5 inches to about 4 inches, and most preferably about 3 inches. Dimension (L2) representing the distance from the bottom edge of the side flap to the apex of the bottom flap (11) ranges from about 1.75 inches to about 5.25 inches, preferably from about 2.5 inches to about 4.0 inches, and most preferably about 3.5 inches. Also shown is dimension (T) representing the thickness of the preferred device at the edges which ranges from about 0.25 inches to about 0.75 inches, preferably from about 0.35 inches to about 0.65 inches and most preferably about 0.50 inches.

Now referring to FIG. 3, an environmental view of the preferred embodiment of the invention, one can see that top flap (10) can be used to secure the invention to a desired location. Here, top flap (10) is hooked into the space between a car window and the car door. Flaps 12A and 12B conform to the surface of the object, in this case a coffee mug, and flap (11) supports the bottom surface of the coffee mug.

Figure 4:
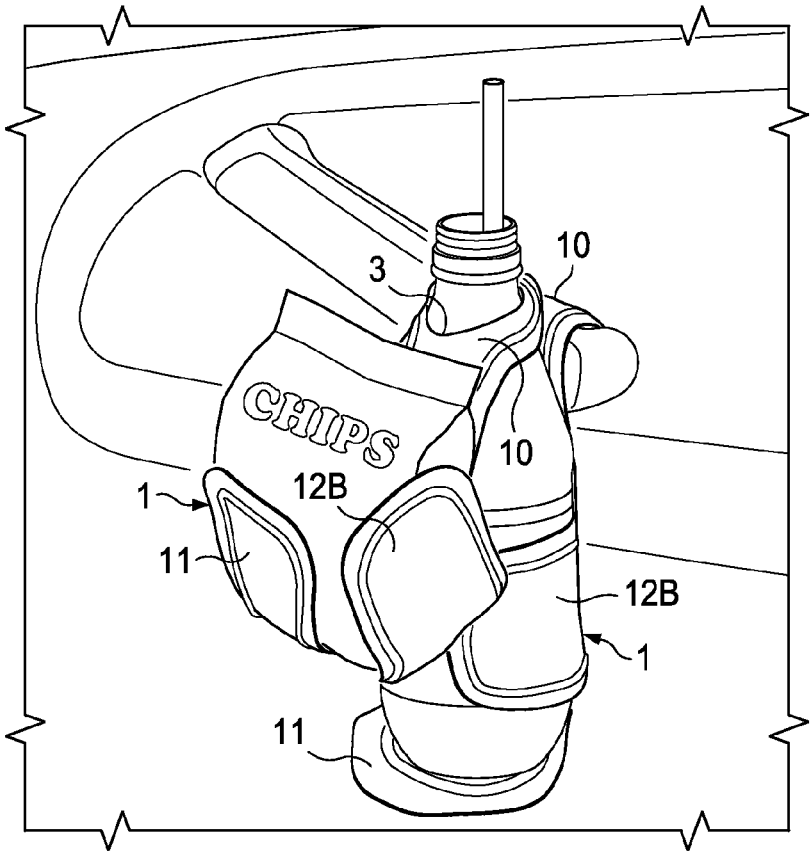
FIG. 4 is an environmental view showing the versatility of the invention.

Now referring to FIG. 4, FIG. 4 demonstrates the use of two of the holders in tandem. The first holder is secured to the door handle by wrapping top flap (10) around the door handle. The object (a bottle of carbonated beverage) is held by the first holder by conforming the flaps 12 and 11 thereto. A second holder is shown secured to the bottle being held by the first holder by means of aperture (3) defined by top flap (10) which slips over the bottle. The second holder can thereby advantageously secure another item, in this case, a bag of chips.

Aperture (3) defined by top flap (10) has multiple potential uses. In addition to the use illustrated in FIG. 4, it can be used to hang the holder on a belt, hook, or a protruding object. It could be provided with features so as to be used as a bottle opener. If so used, the aperture may be reinforced with a metal or hard plastic means for opening a bottle. Alternatively, the frame may be fitted with a bridging structure which spans from one side of the frame defining top flap (10) to the other and incorporates a bottle opener that coincides with aperture (3) and is secured about the aperture. In addition to use in a vehicle such as in FIG. 4, it may conveniently be used in many other ways, for example at an informal gathering such as a cocktail party or the like in order to allow the user to append a snack to a bottle he or she is carrying in order to free up the other hand. Dimensions for aperture (3) are from about 0.25 inches to about 1.75 inches, preferably about 0.5 inches to about 1.5 inches and most preferably about 1.0 inches in diameter.

Figure 5:
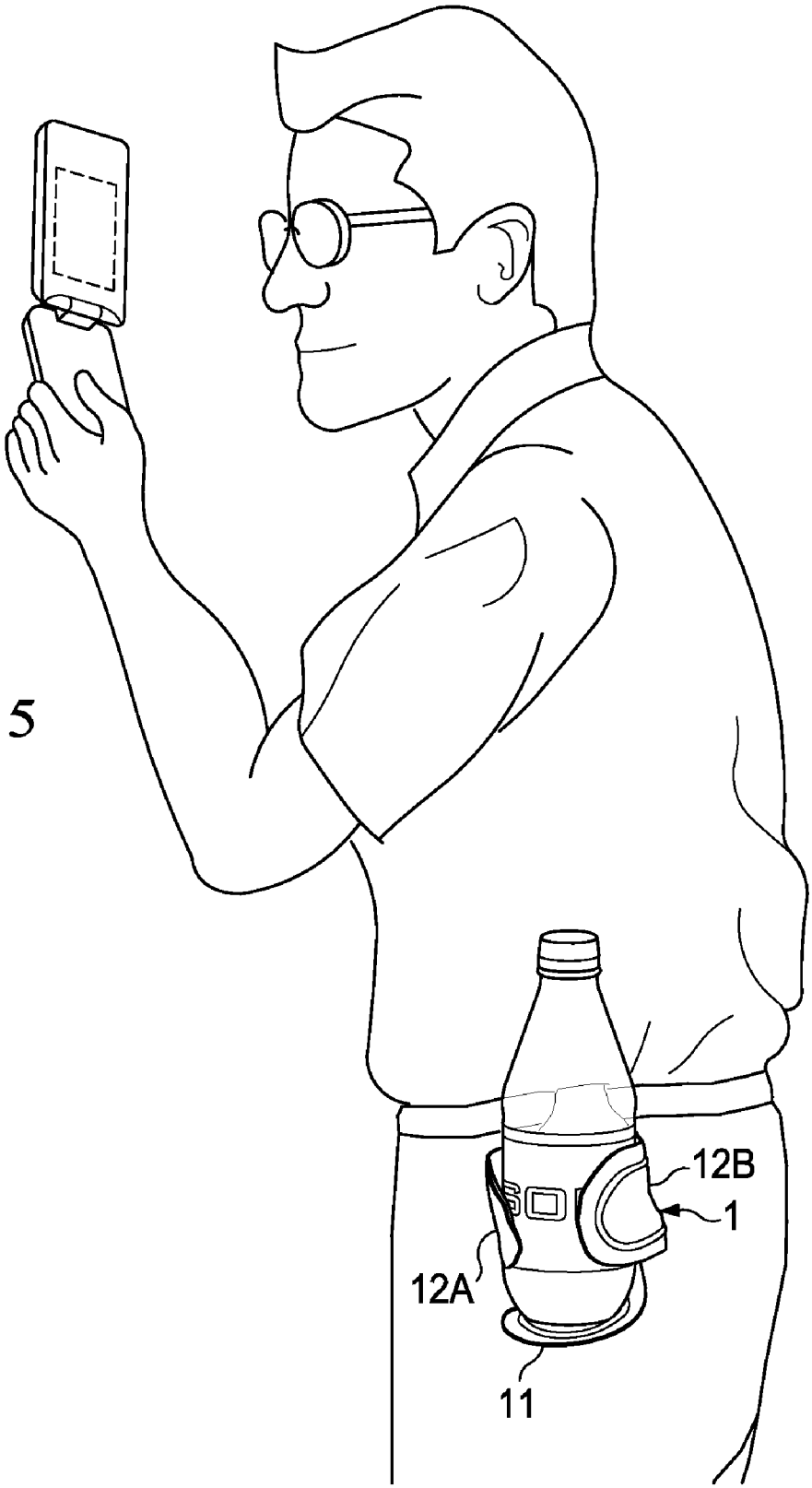
FIG. 5 is an environmental view showing the versatility of the invention.

Now referring to FIG. 5, an alternative environmental view is illustrated wherein the holder is secured to a belt, pant rim, pocket, or the like worn by the user. A bottle can be secured in the holder, thus freeing up the hands of the user for exercise or other activities. For example, a coach could utilize the holder to keep a bottle of water within easy reach, yet be able to write on a chalkboard, use a whistle, or be able to run down a field to provide instructions to his or her players. A power walker could take a beverage, snack, radio, music player, heart monitor, pooper scooper, or any other object along for the walk.

The invention may be manufactured by variety of methods. A preferred method is as follows:

The wire selected for the frame support, such as 14 gauge steel wire, is first formed in the desired shape. This can be done by first rolling the wire by hand or any mechanical aid and placing it over a forming fixture which is configured in the desired shape and size. Another method is the use of a Computer Numerical Control (CNC) wire or spring forming machine which can be programmed to provide wire in the desired size and shape.

In the manufacturing process, the covering material may be cut into a shape essentially the same as the desired frame support configuration, but large enough to overlap said frame support. Two layers of covering material which each have an external and an internal side should be cut. The internal sides will fit together to encase the frame support. If said covering material has adhesive, the adhesive will hold the frame support in place and the edges of the covering material will adhere together.

Another method is to use a roll laminator machine. The frame support is placed into the machine where single-sided or dual-sided laminating can be performed. If a roll laminating machine is used, the dual-sided laminating is preferred to allow both covering sides to be secured together easily. The machine secures both covering sides by heat sealing them together. The laminating material may also have a self-backed adhesive for added security of frame support and covering layers. In this method, a roll die may be used to cut the desired shapes in the covering material after the laminating is completed.

Another method, as shown in FIG. 6, can be cutting the covering layers independently and applied to the frame thereafter using a holding and locating machine. This machine holds and properly aligns the covering layer pieces and the frame support piece as seen in FIG. 6A. FIG. 6B demonstrates the two sides being pressed together, with the final product shown in FIG. 6C.

Figure 7:
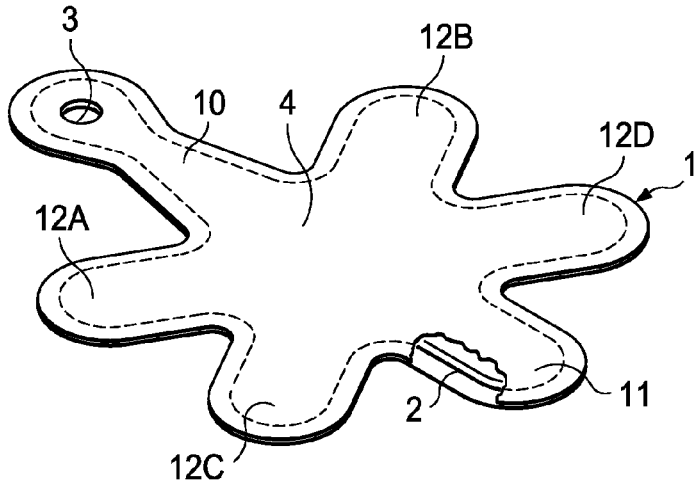
FIG. 7 is a perspective view of an alternative embodiment of the invention.
Figure 8:
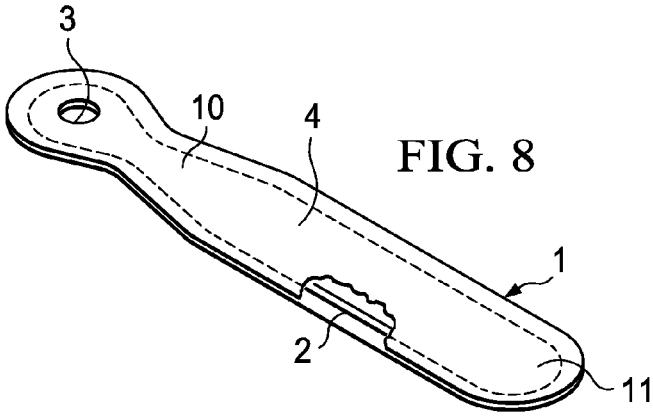
FIG. 8 is a perspective view of another alternative embodiment of the invention.
Figure 9:
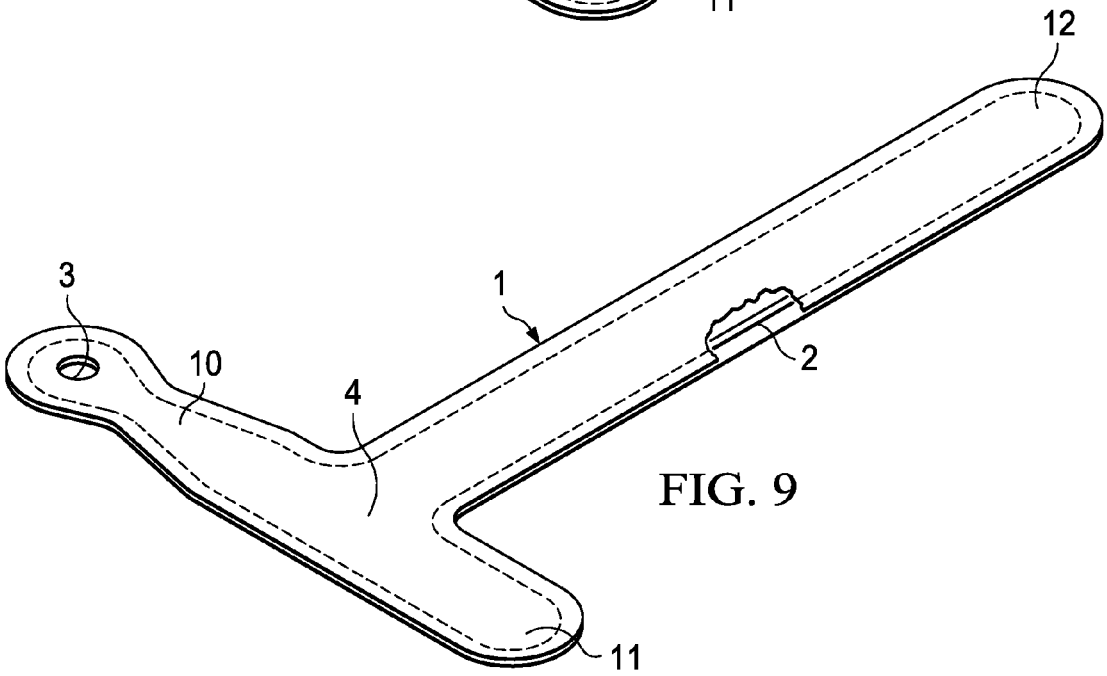
FIG. 9 is a perspective view of another embodiment of the invention.

Now referring to FIGS. 7, 8, and 9, alternative embodiments are illustrated. FIG. 7 demonstrates an embodiment with six total flaps. Flaps (12C and 12D) provide additional support. FIG. 8 demonstrates an embodiment with only two flaps for minimum support. FIG. 9 demonstrates an embodiment with three flaps. Flap (12) is created longer to allow it to wrap around object.

While the embodiments shown in FIGS. 7, 8 and 9 may be made with appropriate dimensions to serve the intended function, exemplary dimensions are provided.

For the embodiment illustrated in FIG. 7, all flaps are preferably from about 1.5 inches wide to about 4.5 inches wide, more preferably from about 2 inches wide to 3.5 inches wide, and most preferably about 3.0" wide. The flaps are about 3.5" long+/−50 percent. The total width of the device when in a flat configuration is from about 5 inches to about 15 inches, more preferably from about 7.5 inches to about 12 inches and most preferably about 10 inches.

For the embodiment shown in FIG. 8, the width may be about 3.0" wide+/−50 percent. The total length may be from about 6 inches to about 18 inches, more preferably from about 9 inches to about 16 inches, and most preferably about 12 inches.

For the embodiment illustrated in FIG. 9, the width is preferably 3.0" wide+/−50 percent, the length of short side 12"+/−50%, and the length of long flap 14"+/−50%. The total width is preferably about 17".

I claim:

1. A holder for an object, comprising:

(a) a frame support comprising a length of metal wire formed into an initial pre-determined essentially planar configuration, said frame support defining a central core area and three or more flaps extending therefrom and co-planar therewith, said wire having sufficient ductility so that said initial essentially planar configuration can be conformed by a user to a second configuration adapted to the shape of said object and defined by said flaps which remains in the shape of said object until reconfigured by a user, and which has sufficient strength to support said object, wherein said wire has properties which permit a user to reconfigure said second configuration to a third configuration, said third configuration selected from an essentially planar configuration and a three-dimensional configuration defined by said flaps;

(b) a covering encasing said frame support, said covering comprising two layers of pliable sheet material having outer edges, said two layers adhered to each other along said outer edges, whereby said frame support is encased therebetween and whereby said covering encases the surface of said wire and provides a surface for contact with said object along said wire and interior to said flaps defined by said wire.

2. The holder of claim 1, wherein three to six flaps extend from said central core.

3. The holder of claim 1, wherein four flaps extend from said central core.

4. The holder of claim 1, wherein an aperture is defined in at least one of said one or more flaps.

5. The holder of claim 4, wherein said aperture is reinforced with a bottle opener means.

6. The holder of claim 1, wherein said second configuration consists of said flaps bent to conform to a standard beverage can.

7. The holder of claim 1, wherein said covering comprises a printable material.

8. The holder of claim 7, further comprising a printed message affixed to said printable material.

9. The holder of claim 7, wherein said printable material is calendared vinyl which is between 3-8 mil.

10. The holder of claim 1, further comprising a double faced edging secured to the outside perimeter of said flap material.

11. The holder of claim 1, wherein said formed configuration supports an object up to about three to five pounds in weight.

12. The holder of claim 11, wherein said object is a beverage container.

13. A holder for an object, comprising:

(a) a frame support comprising a length of metal wire formed into an initial pre-determined essentially planar configuration, said frame support defining a central core area and four flaps extending from, and coplanar with, said central core area, said four flaps including a top flap, a bottom flap and first and second side flaps, each of said flaps having an apex, and said side flaps having a top edge and a bottom edge, said wire having sufficient ductility so that said initial essentially planar configuration can be conformed by a user to a second configuration adapted to the shape of said object and defined by said flaps, which remains in the shape of said object until reconfigured by a user, and which has sufficient strength to support said object, wherein said wire has properties which permit a user to reconfigure said second configuration to a third configuration, said third configuration selected from an essentially planar configuration and a three-dimensional configuration defined by said flaps; and (b) a covering encasing said frame support, said covering comprising two layers of pliable sheet material having outer edges, said two layers adhered to each other along said outer edges, whereby said frame support is encased therebetween and whereby said covering encases the surface of said wire and provides a surface for contact with said object along said wire and interior to said flaps defined by said wire.

14. The holder of claim 13, wherein the distance from the apex of said first side flap to said second side flap is from about 5 inches to about 15 inches.

15. The holder of claim 13, wherein the distance from the apex of said top flap to said bottom flap is from about 6 inches to about 18 inches.

16. The holder of claim 13, wherein said bottom flap extends from about 1.75 inches to about 5.25 inches from said bottom edge of said side flaps.

17. The holder of claim 13, wherein the distance from said top edge of said side flap to the bottom edge of said side flap is from about 0.25 inches to about 5.0 inches.

18. The holder of claim 13, wherein said top flap defines an aperture therein, said aperture having a diameter from about 0.25 inches to about 1.75 inches.

* * * * *